US005927116A

United States Patent [19]

Emoff

[11] Patent Number: 5,927,116

[45] Date of Patent: Jul. 27, 1999

[54] PULL-APART KEY HOLDER

[76] Inventor: Michael J. Emoff, 5450 Sherfield Dr., Trotwood, Ohio 45426

[21] Appl. No.: 09/092,697

[22] Filed: Jun. 5, 1998

Related U.S. Application Data

[60] Provisional application No. 60/051,875, Jun. 6, 1997.

[51] Int. Cl.[6] ..... A47G 29/10

[52] U.S. Cl. ..... 70/456 R; D3/207; 70/459

[58] Field of Search ..... 70/456 R, 457–460; 206/37, 37.1, 38, 38.1, 305, 37.4, 37.5, 37.6, 37.7, 37.8; 24/3.6; D3/207–212

[56] References Cited

U.S. PATENT DOCUMENTS

| | | | |
|---|---|---|---|
| 2,615,227 | 10/1952 | Hornik | 70/457 |
| 2,892,537 | 6/1959 | Schwartz | 70/459 X |
| 3,695,074 | 10/1972 | Smyth et al. | 70/456 R |
| 3,777,523 | 12/1973 | Holland | 70/459 X |
| 3,979,934 | 9/1976 | Isenmann | 70/459 |
| 4,309,883 | 1/1982 | Brentini | 70/456 R |
| 4,422,315 | 12/1983 | Klose | 70/456 R |
| 4,713,951 | 12/1987 | Ros | 70/459 X |
| 4,736,604 | 4/1988 | Zeller, Jacques et al. | 70/457 |
| 5,058,405 | 10/1991 | Stillwagon | 70/456 R |
| 5,209,090 | 5/1993 | Stillwagon | 70/456 R |
| 5,261,257 | 11/1993 | Collier | 70/456 R |
| 5,520,036 | 5/1996 | Collier | 70/456 R |

FOREIGN PATENT DOCUMENTS

| | | | |
|---|---|---|---|
| 1461634 | 11/1966 | France | 70/459 |
| 2093340 | 9/1982 | United Kingdom | 70/456 R |

*Primary Examiner*—Lloyd A. Gall
*Attorney, Agent, or Firm*—Roger S. Dybvig

[57] ABSTRACT

A key holder comprises a pair of key rings each connected to a fob, and the fobs can be releasably secured to one another. The fobs are configured as conventional male and female electrical connector plugs, such as conventional blade-type electrical connector plugs. The plugs are miniaturized to prevent connection to an actual current-carrying outlet or plug. In a second embodiment, the fobs are configured as fractional portions of a sport's game piece, such as a baseball, and create the appearance of the sport's game piece when secured together.

11 Claims, 1 Drawing Sheet

PULL-APART KEY HOLDER

CROSS REFERENCE TO RELATED APPLICATIONS

This application claims the benefit of copending U.S. Provisional Application No. 60/051,875, filed Jun. 6, 1997.

FIELD OF THE INVENTION

This invention relates to a key holder and, more particularly, to a dual ring, pull-apart key holder.

BACKGROUND OF THE INVENTION

Typical key holders comprise a split ring to which keys can be secured in a well known manner, and a fob is commonly secured to the ring as well. It is also known to provide a key holder having two key rings that are releasably attached to each other. One group of keys is secured to one ring, and another group of keys is secured to the other ring. The rings can be released from one another so that the two groups of keys are separable.

SUMMARY OF THE INVENTION

A primary object of this invention is to provide a dual ring key holder wherein the key rings are connected to fobs that are releasably connected to one another using conventional male and female electrical plug connections.

Another object of this invention is to provide a dual ring key holder wherein one ring is secured to a fob in the form of a female, blade-type electrical plug and the other ring is secured to a fob in the form of a male, blade-type electrical plug, with the plugs being secured to one another to releasably connect the two key rings.

A still further object of this invention is to provide a dual ring key holder wherein each of the key rings is secured to a fob configured as a fractional portion of a sport's game piece, such as a baseball or the like, and wherein the two fobs can be releasably secured together to create the appearance of a sport's game piece.

A key holder in accordance with this invention comprises first and second key rings secured to corresponding first and second key fobs, as by straps integral with the fobs. One of the fobs comprises a male member having at least one but preferably a pair of mutually-spaced blades projecting therefrom. As a result, the male fob has the general appearance of a conventional, male blade-type electrical connector plug. The other fob comprises a female member having a number of blade-receiving sockets therein corresponding to the number of blades on the male fob. Accordingly, the female fob has the general appearance of a conventional, female blade-type electrical connector plug. The male and female fobs are releasably secured together by inserting the blades of the male fob into the sockets of a female fob, as if the fobs were male and female electrical connector plugs being secured together to form an electrical connection.

The fobs may have any suitable shape. For example, the fobs may have the appearance of conventional female and male electrical connector plugs, including plugs other than blade-type connector plugs, preferably in miniature so that they cannot be connected to actual current-carrying electrical outlets or connector plugs. Each of the straps connecting the fobs to the key rings may be configured as a conventional insulated power cable or cord without internal conductors. In another embodiment, the fobs may be configured as fractional portions of a sport's game piece, such as a baseball, basketball, football, soccer ball, tennis ball, golf ball, hockey puck, or the like, in which case the fobs create the appearance of a complete sport's game piece when secured together.

The foregoing and other objects and advantages of this invention will become apparent from the following description and accompanying drawings.

DETAILED DESCRIPTION

Figure 1:
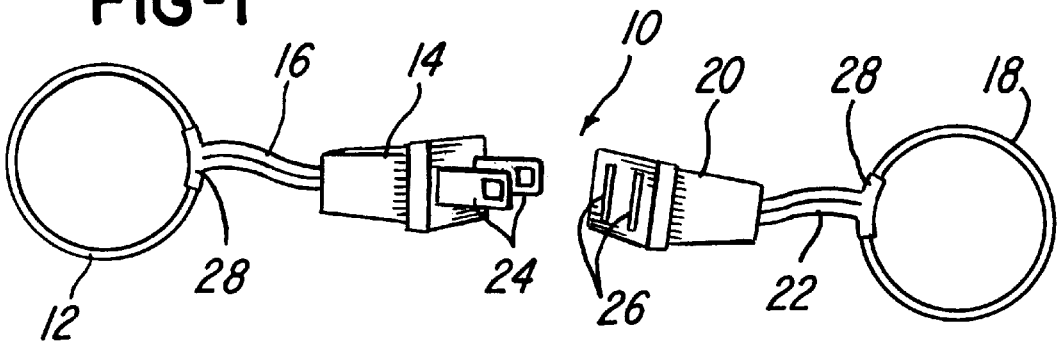
FIGS. 1 and 2 show a first embodiment of a key holder in accordance with this invention.
Figure 2:
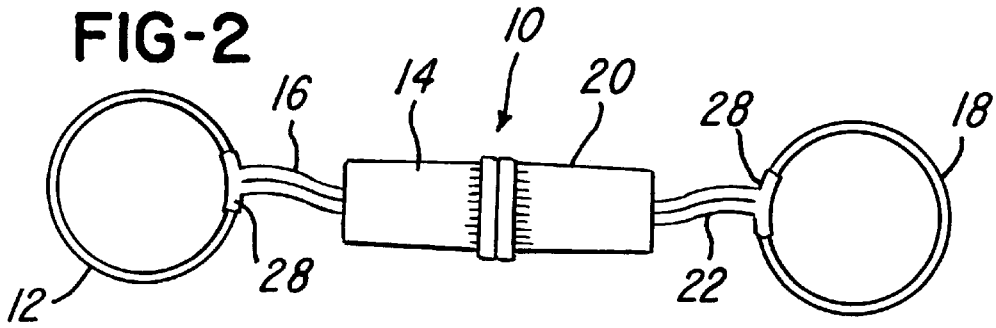

With reference to FIGS. 1 and 2, a key holder, generally designated 10, in accordance with this invention comprises a first key ring 12 connected to a male fob 14 by a connecting strap 16. A second key ring 18 is connected to a female fob 20 by a connecting strap 22. The key rings 12 and 18 may be conventional split-ring key rings and are not described in detail herein. Each of the fobs 14 and 20 is preferably molded from a high density rubber material as one solid piece integral with its corresponding connecting strap 16 or 22. As best shown in FIG. 1, the male fob 14 is preferably configured as a conventional, male blade-type electrical connector plug, and the connecting strap 16 has the appearance of a conventional two-conductor, insulated power cord (without the internal conductors). The male fob 14 has a pair of mutually-spaced metal blades 24 projecting therefrom, and the fob 14 is preferably molded onto the blades 24. For this purpose, the blades 24 may have tabs or knurled surfaces or the like (not shown) to help secure them to the fob 14 during the molding process.

The female fob 20 is preferably configured as a conventional, female blade-type electrical connector plug, and the connecting strap 22, like the strap 16, has the appearance of a conventional two-conductor, insulated power cord. Accordingly, the female fob 20 has a pair of mutually-spaced sockets 26 dimensioned to snugly receive the blades 24 projecting from the male fob 14. The male fob 14 and the female fob 20 can be plugged into one another to releasable secure the key rings 12 and 18 together. When a key or keys (not shown) on the key ring 12 are needed while a key (not shown) on the key ring 18 is in use, or vice versa, the fobs 14 and 20 can be unplugged from one another to separate the keys. For example, if a key on the fob 20 is in the ignition of a running automobile and a key on the fob 14 is needed to open the door to a building or the like, the fob 14 can be removed from the fob 20 without removing the ignition key from the automobile.

The fobs 14 and 20 may be configured as polarized or non-polarized electrical connector plugs. However, a polarized plug configured, i.e. wherein one blade 24 is shaped differently to than the other, provides the advantage that the key holder 10 can only be assembled with the fobs 14 and 20 in one orientation. This is advantageous in cases where indicia, such as advertising, is printed on the fobs 14 and 20 so that the indicia on the fob 14 is properly oriented relative to the indicia on the fob 20, and vice versa. Although not shown, the fobs 14 and 20 may also be configured as three-prong, grounded electrical connector plugs, such as shown in U.S. Pat. No. 5,340,330 to Dolson et al., which is hereby incorporated by reference herein. In addition, the fobs 14 and 20 may be configured as electrical connector plugs other than blade-type electrical connector plugs, and the connecting straps 16 and 22 may be configured as suitably-corresponding electrical cables or cords. The plugs formed by the fobs 14 and 20 are preferably miniature versions of actual electrical connector plugs so that they cannot be connected to actual current-carrying outlets or plugs. The use of a high density rubber material to form the fobs 14 and 20 also helps to electrically insulate the plugs in the event they are connected to a current-carrying outlet or electrical plug.

With continued reference to FIGS. 1 and 2, the connecting straps 16 and 22 each have formed at the free end thereof a hollow tubular member 28 used to secured the straps 16 and 22 to their corresponding key rings 12 and 18. Each hollow tubular member 28 is slid onto its corresponding key ring 12 or 18 in a well known manner by inserting one end of the split ring 12 or 18 into the tubular member 28 and moving the tubular member about the split ring 12 or 18 until both ends of the split ring 12 or 18 have passed through the tubular member 28.

Figure 3:
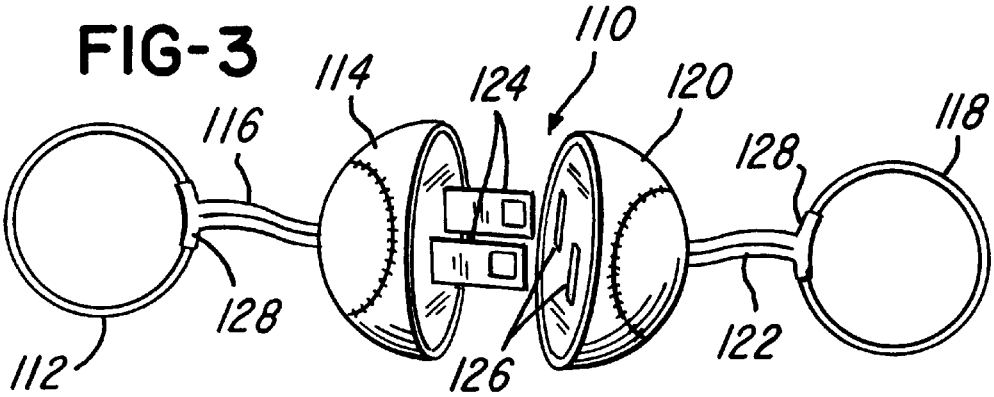
FIGS. 3 and 4 show a second embodiment of a key holder in accordance with this invention.
Figure 4:
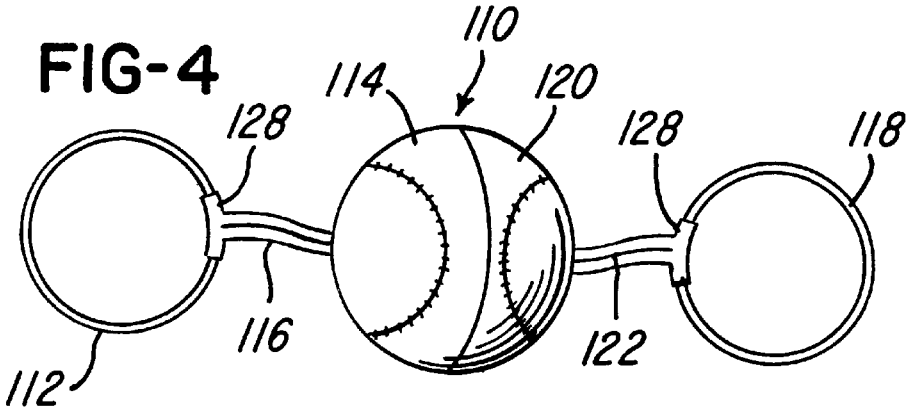

FIGS. 3 and 4 illustrate a second embodiment of a key holder, generally designated 110, in accordance with this invention. Apart from the appearance of certain parts, the key holder 110 may have the same construction as the key holder 10 illustrated in FIGS. 1 and 2. Accordingly, like parts appearing in FIGS. 3 and 4 are given reference numbers corresponding to the same parts in FIGS. 1 and 2, but increased by 100. For example, the fob 14 in FIGS. 1 and 2 corresponds to the fob 114 in FIGS. 3 and 4, and so on.

In the key holder 110, the fobs 114 and 120 are connected together in the same manner as the fobs 14 and 20, but they create the appearance of a sport's game piece when assembled together. Accordingly, the fob 114 and the fob 120 each has the appearance of a fractional portion, e.g. half, of a sport's game piece, such as a baseball as illustrated in FIGS. 3 and 4. Of course, the fobs 114 and 120 may create the appearance of any other sport's game piece, such as a basketball, football, soccer ball, tennis ball, golf ball, hockey puck, or the like. The fobs 114 and 120, regardless of the appearance they create, are preferably molded in one solid piece from a high density rubber material and are integrally molded with their corresponding connecting straps 116 and 122.

Although the presently preferred embodiments of this invention have been described, it will be understood that within the purview of the invention various changes may be made within the scope of the following claims.

Having thus described my invention, I claim:

1. A key holder comprising:

a first key ring connected to a first fob member;

a second key ring connected to a second fob member;

said key holder being characterized in that said first fob member is configured as a female electrical connector plug and said second fob member is configured as a male electrical connector plug, said fob members being releasably secured together by plugging said second fob member into said first fob member, or vice versa.

2. The key holder of claim 1 wherein said second fob member has a pair of mutually-spaced blades projecting therefrom and wherein said first fob member has a pair of mutually-spaced, blade-receiving sockets formed therein adapted to receive the blades projecting from said second fob member.

3. The key holder of claim 1 wherein each of said fob members is secured to its corresponding key ring by a connecting strap configured as an electrical cord.

4. The key holder of claim 1 wherein said first fob member is further configured as a first fractional portion of a sport's game piece and said second fob member is further configured as a second, complementary fractional portion of said sport's game piece, and wherein said fob members, when secured together, create the appearance of said sport's game piece.

5. The key holder of claim 4 wherein said sport's game piece is a baseball.

6. The key holder of claim 1 wherein said male connector plug is made from metal.

7. The key holder of claim 6 wherein said first fob member has a body made from a rubber material.

8. A key holder, comprising:

a first key ring;

a first fob member connected to said first key ring, said first fob member having projecting therefrom a pair of mutually-spaced blades;

a second key ring; and a second fob member connected to said second key ring, said second fob member having formed therein a pair of mutually-spaced, blade-receiving sockets adapted to receive the blades projecting from said first fob member, wherein said fob members can be releasably secured together by inserting said blades into said sockets wherein said first fob member is configured as a first fractional portion of a sport's game piece and said second fob member is configured as a second, complementary fractional portion of said sport's game piece, and wherein said fob members, when secured together, create the appearance of said sport's game piece.

9. The key holder of claim 8 wherein said sport's game piece is a baseball.

10. The key holder of claim 8 wherein said blades are made from metal.

11. The key holder of claim 10 wherein said second fob member has a body made from a rubber material.

* * * * *